US008588675B2

(12) United States Patent
Onodera

(10) Patent No.: US 8,588,675 B2
(45) Date of Patent: Nov. 19, 2013

(54) IMAGE FORMING SYSTEM

(75) Inventor: Masahiro Onodera, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 294 days.

(21) Appl. No.: 13/043,833

(22) Filed: Mar. 9, 2011

(65) Prior Publication Data

US 2011/0229169 A1 Sep. 22, 2011

(30) Foreign Application Priority Data

Mar. 16, 2010 (JP) ..... 2010-058993

(51) Int. Cl.
*G03G 15/22* (2006.01)
*G03G 15/00* (2006.01)

(52) U.S. Cl.
USPC ..... 399/406; 399/361; 399/38

(58) Field of Classification Search
USPC ..... 399/45, 406
See application file for complete search history.

(56) References Cited

U.S. PATENT DOCUMENTS

| | | | | |
|---|---|---|---|---|
| 6,512,914 | B2 * | 1/2003 | Kabashima | 399/341 |
| 7,197,271 | B2 * | 3/2007 | Nakamura et al. | 399/341 |
| 7,515,862 | B2 * | 4/2009 | Shida et al. | 399/341 |
| 8,029,126 | B2 * | 10/2011 | Imoto | 347/104 |

FOREIGN PATENT DOCUMENTS

| | | | |
|---|---|---|---|
| JP | 08225216 | A * | 9/1996 |
| JP | 2007-062970 | A | 3/2007 |
| JP | 2007155855 | A * | 6/2007 |

* cited by examiner

*Primary Examiner* — Clayton E Laballe
*Assistant Examiner* — Leon W Rhodes, Jr.
(74) *Attorney, Agent, or Firm* — Holtz, Holtz, Goodman & Chick, PC

(57) ABSTRACT

An image forming system including: a fixing device for fixing a toner image on the recording sheet; a curl flattening section for flattening a curl formed on the recording sheet, and conveying the recording sheet in a downstream direction against the fixing device; a first conveying route for conveying the recording sheet having been processed by the fixing device to the curl flattening section; a second conveying route, being longer than the first conveying route, for conveying the processed recording sheet to the curl flattening section; a switching section for switching the conveying route, to guide to the first conveying route or the second conveying route; and a control section for controlling the switching section to guide the recording sheet to the first conveying route or the second conveying route, based on a type of the recording sheet, having been processed by the fixing device.

17 Claims, 9 Drawing Sheets

IMAGE FORMING SYSTEM

CROSS REFERENCE TO RELATED APPLICATION

This application is based on Japanese Patent Application No. 2010-058993 filed on Mar. 16, 2010 with the Japanese Patent Office, the entire content of which is hereby incorporated by reference.

TECHNICAL FIELD

The present invention relates to an image forming system, including a heat fixing device to fix a toner image deposited on a recording sheet, onto the recording sheet.

BACKGROUND ART

The usage of electro-photographic image forming apparatuses has expanded from office uses to printing fields. The electro-photographic image forming apparatuses have been widely used for forming full-color images. Due to the expansion of usage, image forming performance, which can exhibit high gloss and high brightness on various kinds of recording sheets, is required to the electro-photographic image forming apparatuses.

In order to meet the above requirement, a technology is offered as a fixing method for increasing the brightness (being smoothness) of the toner image carried on the recording sheet. For example, a recording sheet, carrying an un-fixed toner image, is processed by two fixing devices, that is, double fixing processes are carried out. However, if a recording sheet is processed by a fixing device having a high brightness performance, uneven brightness is adversely generated on a specific recording sheet by a curl flattening section and sheet ejection rollers, mounted at downstream of the fixing device. Accordingly, image forming apparatuses has been offered, carrying an uneven brightness preventing means, as shown in a following document.

An image forming system, described in Unexamined Japanese Patent Application Publication No. 2007-62970, is configured to include an intermediate sheet rejection unit, which can cool a recording sheet processed by a fixing means which is mounted between the fixing means within an apparatus and a sheet ejection option connected to the apparatus. Accordingly, the time interval, during which the specific recording sheet passes through the intermediate sheet ejection unit, is controlled to be longer than time interval during which other recording sheets pass though said unit. As result, the toner image on the specific recording sheet is cooled to a temperature at which no uneven brightness is generated by rollers mounted in said sheet ejection unit. Subsequently, said specific recording sheet is conveyed to said sheet ejection unit, so that no uneven brightness is generated by the above-described image forming system.

However, according to the above-described technology, the necessary time interval for processing a single specific recording sheet becomes longer than the time interval for processing a recording sheet other than the specific recording sheet, that is, an additional time interval, in which the recording sheet stops at the intermediate sheet ejection unit, is required for the single specific recording sheet. Accordingly, an image forming productivity for the specific recording sheet is adversely reduced to be less than the image forming productivity of the recording sheet other than the specific recording sheet.

Due to the above problem, the technology described in the above patent document is not suitable for the image forming system to be used in the office or the printing field, which requires a high-speed process.

An object of the present invention is to offer an image forming system which makes it possible to rapidly form high quality images exhibiting no uneven brightness, regardless of the type of the recording sheets.

SUMMARY OF THE INVENTION

To achieve at least one of the abovementioned objects, an image forming system reflecting one aspect of the present invention has:

a fixing device which applies heat and pressure onto a toner image formed on a recording sheet to fix the toner image on the recording sheet;

a curl flattening section for flattening a curl formed on the recording sheet, and conveying the recording sheet in a downstream direction against the fixing device with respect to a sheet conveying direction;

a first conveying route for conveying the recording sheet having been processed by the fixing device to the curl flattening section;

a second conveying route, which is longer than the first conveying route, for conveying the recording sheet having been processed by the fixing device to the curl flattening section;

a switching section for switching the conveying route of the recording sheet, having been processed by the fixing device, to guide to the first conveying route or the second conveying route; and a control section for controlling the switching section to guide the recording sheet to the first conveying route or the second conveying route, based on a type of the recording sheet, having been processed by the fixing device.

Further, a sheet post-finishing device to finish a recording sheet carrying a toner image having been fixed by heat and pressure, reflecting one aspect of the present invention has:

a curl flattening section for flattening a curl formed on the recording sheet carrying a fixed toner image, and for conveying the recording sheet carrying the fixed toner image in a sheet conveying direction;

a first conveying route for conveying the recording sheet carrying the fixed toner image to the curl flattening section;

a second conveying route, which is longer than the first conveying route, for conveying the recording sheet carrying the fixed toner image to the curl flattening section;

a switching section for switching a conveying route of the recording sheet carrying the fixed toner image, to guide the recording sheet to the first conveying route or the second conveying route; and a control section for controlling the switching section to guide the recording sheet carrying the fixed image to the first conveying route or the second conveying route, based on a type of the recording sheet carrying the fixed toner image.

Still further, an image forming system reflecting one aspect of the present invention has:

a fixing device which fixes a toner image on a recording sheet by applying heat and pressure onto the toner image formed on the recording sheet, and a sheet post-finishing device of the recording sheet;

wherein the post-finishing device includes:

a curl flattening section for flattening a curl formed on the recording sheet, and conveying the recording sheet in a sheet conveying direction;

a first conveying route for conveying the recording sheet carrying a toner image having been fixed by the fixing device, to the curl flattening section;

a second conveying route, which is longer than the first conveying route, for conveying the recording sheet carrying the toner image having been fixed by the fixing device, to the curl flattening section;

a switching section for switching a conveying route of the recording sheet, having been fixed by the fixing device, to guide to the first conveying route or the second conveying route; and a control section for controlling the switching section to guide the recording sheet to the first conveying route or the second conveying route, based on a type of the recording sheet, having been fixed by the fixing device.

BRIEF DESCRIPTION OF THE DRAWINGS

An embodiment will now be described, by way of example only, with reference to the accompanying drawings which are meant to be exemplary, not limiting, and wherein like elements are numbered alike in the several figures, in which.

DETAILED DESCRIPTIONS OF THE PREFERRED EMBODIMENTS

Figure 1:
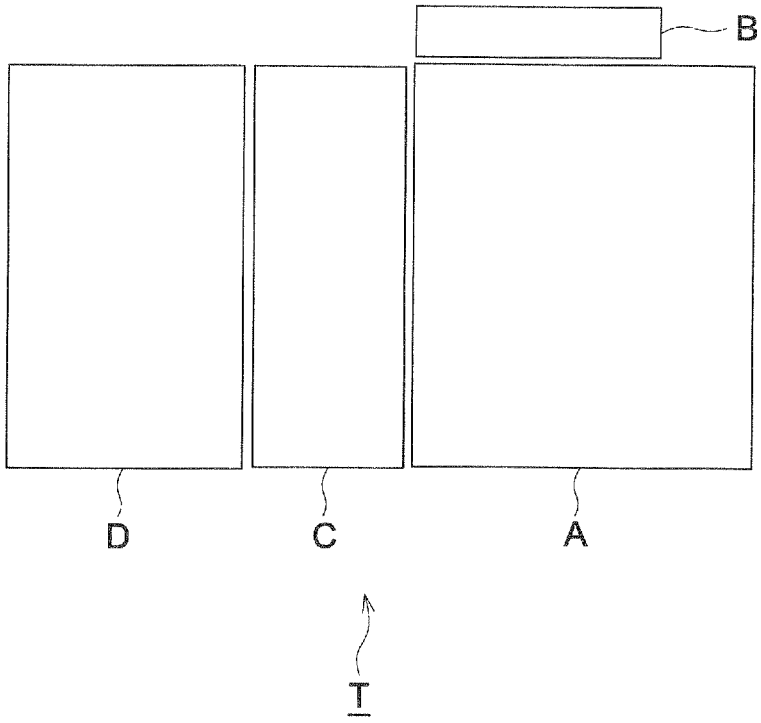
FIG. 1 is a drawing to show the construction of image forming system T relating to the present invention.

An embodiment relating to the present invention will now be detailed while referring to the drawings. The descriptions in this specification are meant not to limit the technical scope of the claims nor the meaning of the terms.

FIG. 1 is a drawing to show the construction of image forming system T relating to the present invention.

Image forming system T is structured of image forming apparatus A having a first fixing device, secondary fixing process device C having a secondary fixing device, and post-finishing device D having a de-curling device to flatten a curled sheet, each relating to the present invention.

[Image Forming Apparatus]

Figure 2:
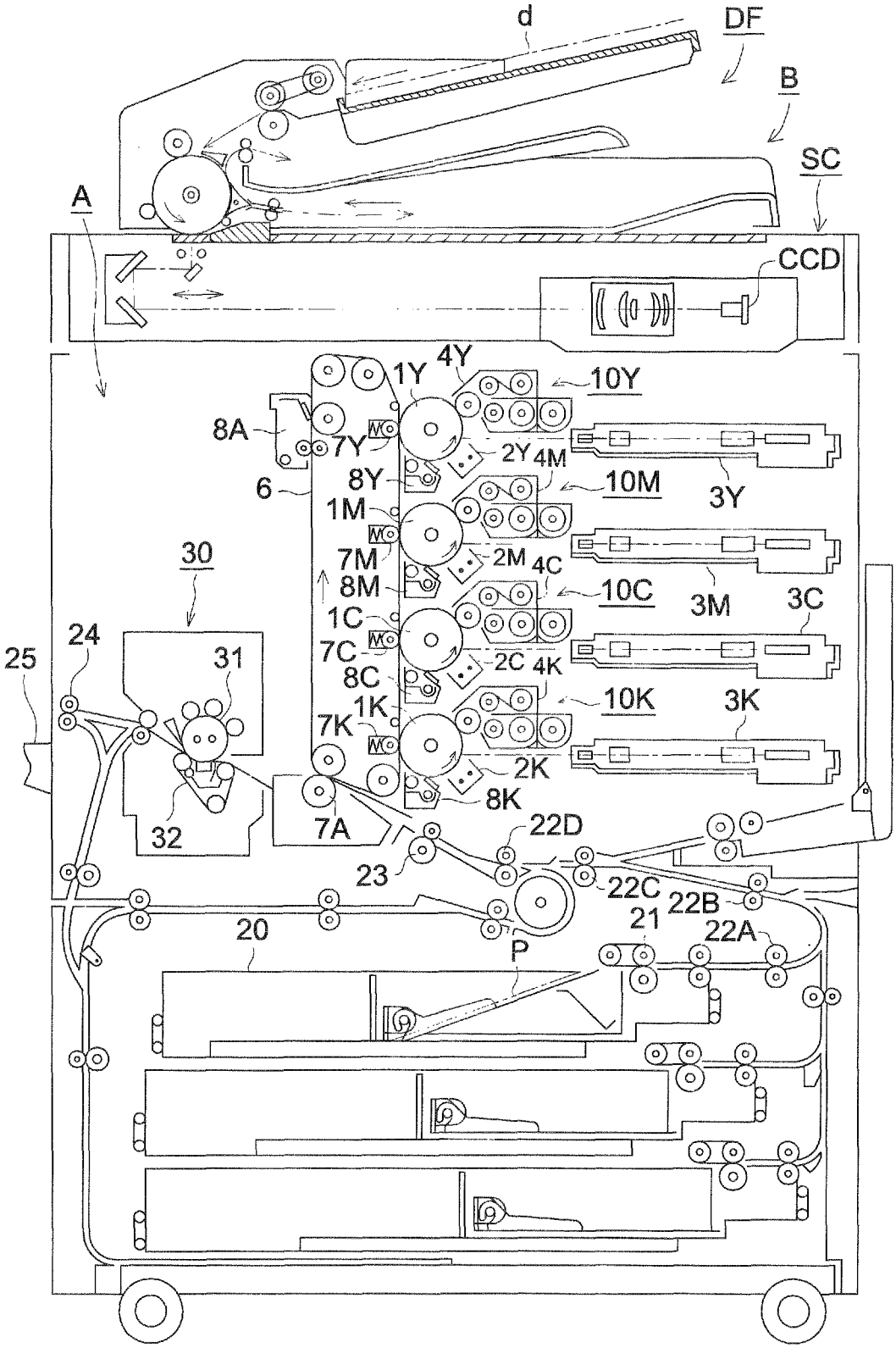
FIG. 2 is a drawing to show an example of an image forming apparatus relating to the present invention.

FIG. 2 is a drawing to show an example of the image forming apparatus relating to the present invention.

Image forming apparatus A includes image reading device B mounted thereon.

Image forming apparatus A is termed as a "tandem type color image forming apparatus", which is structured of image funning sections 10Y, 10M, 10C, and 10K, intermediate transfer body 6, being a looped belt, sheet supplying section 20, fixing device 30, and the like.

Image reading device B, structured of automatic document feeding device DF and scanning exposure device SC, is installed at the top portion of image forming apparatus A. Original document sheet "d", placed on a document platen of automatic document feeding device DF, is conveyed by a conveyance section, after which the images carried on a single surface or on both surfaces of document sheet "d" are scanned and exposed by an optical system of scanning exposure device SC, whereby the images are read by line image sensor CCD.

Signals, which have been photo-electrically converted by line image sensor CCD, are processed, employing such as an analog process, an A/D conversion process, a shading process, and an image compressing process, after which said signals are sent to exposure sections 3Y, 3M, 3C, and 3K.

Image forming section 10Y, which forms the yellow toner images, has charging section 2Y, exposure section 3Y, developing device 4Y, and cleaning section 8Y, all of which are arranged around photoconductor 1Y.

Image forming section 10M, which forms the magenta toner images, has charging section 2M, exposure section 3M, developing device 4M, and cleaning section 8M, all of which are arranged around photoconductor 1M.

Image forming section 10C, which forms the cyan toner images, has charging section 2C, exposure section 3C, developing device 4C, and cleaning section 8C, all of which are arranged around photoconductor 1C.

Image forming section 10K, which forms the black toner images, has charging section 2K, exposure section 3K, developing device 4K, and cleaning section 8K, all of which are arranged around photoconductor 1K.

The set of charging section 2Y and exposure section 3Y, the set of charging section 2M and exposure section 3M, the set of charging section 2C and exposure section 3C, and the set of charging section 2K and exposure section 3K, each set structures a latent image forming section.

In addition, developing devices 4Y, 4M, 4C, and 4K include a dual component developer including toners of yellow (Y), magenta (M), cyan (C), and black (K), and appropriate carriers.

Intermediate transfer body 6 is entrained about a plurality of rollers which are not illustrated, so that it can rotate.

Fixing device 30 heats and presses an unfixed toner image, carried on recording sheet P, using a fix-nipping section, formed between heated fixing member 31 (being a fixing roller) and pressure applying belt 32.

Primary transfer sections 7Y, 7M, 7C, and 7K primarily transfer the color toner images, respectively formed by image forming sections 10Y, 10M, 10C and 10K, onto rotating intermediate transfer body 6 (being a primary transfer operation), whereby each color toner image is superposed, so that a toner image including a full-color image is formed on intermediate transfer body 6. After recording sheet P is supplied from sheet supplying cassette 20 by sheet supplying section 21, recording sheet P is sequentially conveyed to secondary transfer section 7A, by paired sheet supplying rollers 22A, 22B, 22C and 22D, as well as paired registration milers 23. That is, secondary transfer section 7A is configured to transfer the full-color image onto recording sheet P.

After that, recording sheet P carrying the transferred full-color image is heated and pressed by fixing device 30, whereby the color toner image on recording sheet P is permanently fixed. Subsequently recording sheet P carrying the fixed full-color image is conveyed by paired sheet ejection rollers 24 to sheet ejection tray 25, which is installed on the exterior of the image forming apparatus.

After secondary transfer section 7A has transferred the full-color toner image onto recording sheet P, transfer section 7A separates recording sheet P using a sharp-angle conveyance technique. After that, cleaning section 8A removes any toner particles remaining on intermediate transfer body 6.

The above explanation is for a full-color image forming apparatus, however the present invention is also applicable to a monochromatic image forming apparatus. Further, the intermediate transfer body may not be used.

[First Fixing Device]

The main structure of fixing device 30 serving as the first fixing device relating to the present invention will now be detailed below.

Figure 3:
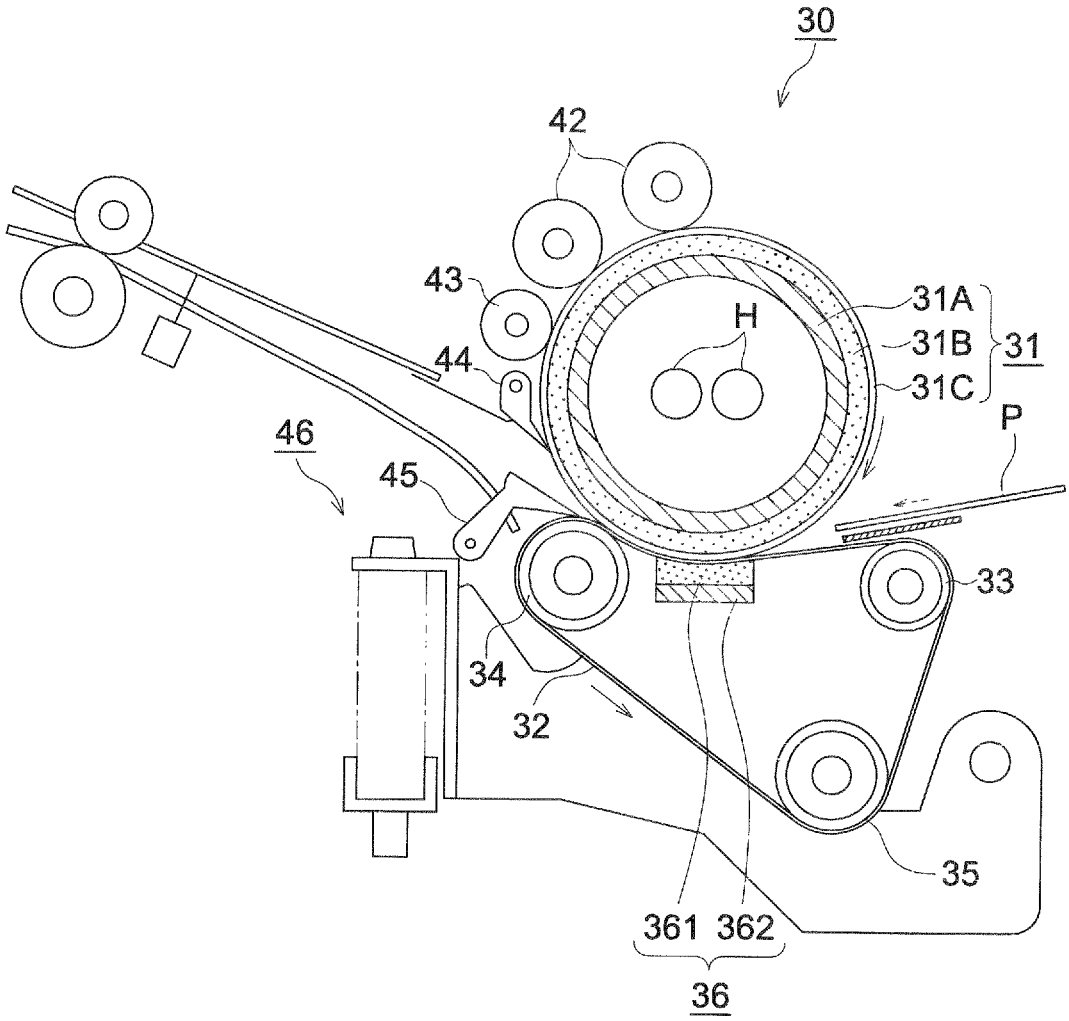
FIG. 3 is a cross-sectional view of fixing device 30 relating to the present invention.

FIG. 3 is a cross-sectional view of fixing device 30 relating to the present invention.

Fixing device 30 relating to the present invention includes fixing roller 31 above the sheet conveying route, and pressure applying belt 32 below the sheet conveying route.

The monochromatic toner image, or the full-color image, carried on recording sheet P, is fixed by heat and pressure, when recording sheet P is conveyed through a nipping area, formed between fixing roller 31 and pressure applying belt 32.

Fixing roller 31, housing halogen lamp H therein, is formed of cylindrical, hollow body 31A, being an aluminum-molded or iron-formed body, with a diameter of 80 mm, elastic layer 31B, formed of a heat-resistant silicon layer with a thickness of 1.5 mm, to cover cylindrical hollow body 31A, and sheet separation layer 31C, formed of fluoroplastic, such as PFA (perfluoroalkoxy) or PTFE (polytetrafluoroethylene) with a thickness of 30 μm, formed to cover elastic layer 31B.

External heating section 42, cleaning section 43, sheet separation claw 44, and a thermal sensor, which is not illustrated, are arranged on the peripheral surface of fixing roller 31.

Pressure applying belt 32, being an endless belt, is structured of a polyimide base body, with an outer diameter of 75 mm, and a thickness of 70 μm, and a sheet separation layer which is formed of PFA or PTFE, with a thickness of 25 μm, to cover the outer surface of the base body.

Pressure applying belt 32 is entrained about entrance roller 33, which is mounted near a sheet entering section, sheet separation roller 34, which is mounted near a sheet exiting section, and steering roller 35, so that pressure applying belt 32 is in contact with the peripheral surface of fixing roller 31.

Sheet separation claw 45 is in contact with the periphery surface of pressure applying belt 32, entrained about sheet separation roller 34, so that sheet separation claw 45 separates sheet P from pressure applying belt 32.

Sheet separation roller 34 is a drive roller to rotate pressure applying belt 32. Steering roller 35 is a roller to stably control pressure applying belt 32 and not to allow a shift in the belt width direction.

Elevating section 46 supports a pressure applying unit, which is structured of pressure applying belt 32, entrance roller 33, sheet separation roller 34, steering roller 35, and the like, so that the pressure applying unit can move vertically to allow pressure applying belt 32 and pressing section 36 to come into pressure contact with fixing roller 31.

Pressing section 36, mounted within the loop of pressure applying belt 32 to press said belt 32 from the inside, is structured of pressing pad 361, sewing as a pressing member, and supporting member 362, mounted on the pressure applying unit to allow pressing pad 361 to press against fixing roller 31. Pressing pad 361 presses the inner surface of pressure applying belt 32, entrained about entrance roller 33 and sheet separation roller 34, so that pressing pad 361 allows pressure applying belt 32 to come into pressure contact with the peripheral surface of fixing roller 31. Pressing pad 361 is formed of a heat-resistant resin, such as a silicon rubber, with a length of 20 mm in the sheet conveying direction, exhibiting JIS A 10° hardness. Since the silicon rubber tends to swell, due to silicon swelling agents, applied on the inner surface of pressure applying belt 32, the silicon rubber is preferably coated with the heat-resistant resins such as FTA or PTFE. The pressing load of pressure applying belt 32 against fixing roller 31 is 400-800 N.

[Prescription of Toner Particles]

The toner particles, used in the present embodiment include 10 parts as offset preventing agents, for 100 parts by mass of resin.

Since the offset preventing agents exhibit a lower melting point, as well as a lower molecular weight, than those of main resin of the toner particles, when the offset preventing agents pass through the nipping area of the fixing device, the offset preventing agents tend to be a melting condition, though the main resin of the toner particles remain a viscoelastic condition. Accordingly, the offset preventing agents expand so as to cover the surface of the toner layers, and the offset preventing agents covers the interface between the surface layer of the fixing member (being the fixing roller) and the toner layer. Due to these characteristics, the offset preventing agents make it possible to separate the toner layer from the surface of the fixing member (being the fixing roller).

In this case, polypropylene wax, exhibiting low-molecular weight, is used as the offset preventing agent, however various waxes, shown below can be used. Hereinafter, the offset preventing agents are referred to as "wax".

In detail, listed are: olefin system wax, such as low-molecular weight polyethylene and copolymerization polyethylene; paraffin wax; ester system wax, having long-chain aliphatic base, such as behenic acid ester, montanic acid ester, and stearic acid ester; plant system wax, such as hydrogenerated ricinus and carnauba wax; ketone body, having long-chain alkyl group, such as distearate ketone; silicon, having alkyl group; higher fatty acid, such as stearic acid; (partial) ester of multiple alcohol, such as long-chain aliphatic base alcohol, pentaerythritol, and tri-methylol propane, and long-chain aliphatic acid; and higher fatty acid amides, such as oleic amide, stearic acid amid; and palmitic acid.

[Secondary Fixing Process Device]

Figure 4:
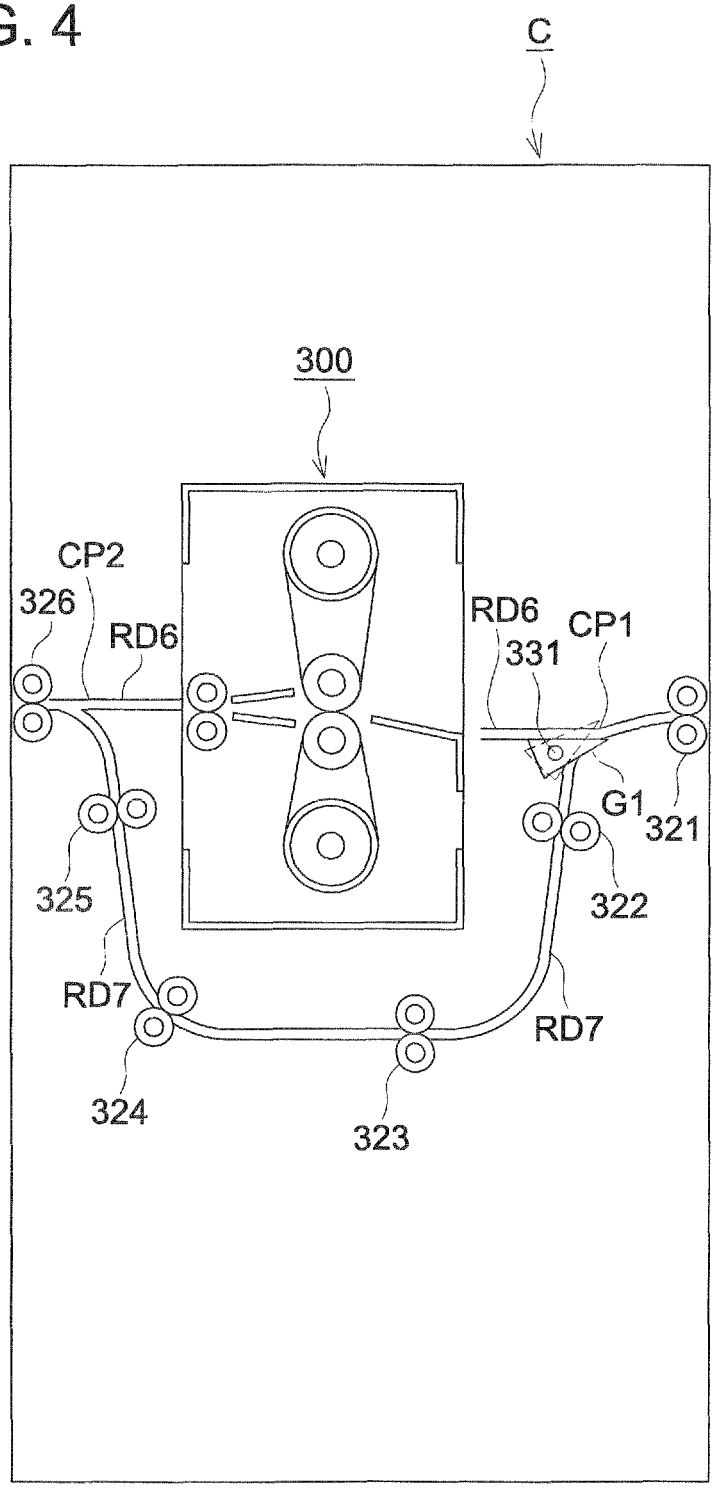
FIG. 4 is a cross sectional view of secondary fixing process device C to be combined downstream of the image forming apparatus.

FIG. 4 is a cross sectional view of secondary fixing process device C to be combined downstream of the image forming apparatus.

Secondary fixing process device C is structured of secondary fixing device 300, serving as the fixing device relating to the present invention, and plural conveying routes RD6 and RD7 to convey the sheet. Secondary fixing device 300 applies heat and pressure again onto the toner image carried on the recording sheet, which has already been fixed by the fixing device (being the primary fixing device), provided in the image forming apparatus, so that the smoothness (being the brightness) and the transparence of the toner image can be increased.

RD6 represents a route, through which the recording sheet is guided to secondary fixing device 300, so that the recording sheet is conveyed to a sheet ejection side of secondary fixing process device C. RD7 represents a bypass route, through which the recording sheet is not guided to secondary fixing device 300, so that the recording sheet is directly conveyed to a sheet ejection side of secondary fixing process device C. Paired rollers 322, 323, 324, and 325 are mounted on conveying route RD7, to convey the recording sheet.

Further in FIG. 4, CP1 represents a branching position where the conveyed recording sheet is branched to route RD6 or RD7. CP2 represents the confluence of route RD6 and route RD7.

Plural switching claws G1 is mounted on branching position CP1 to guide the recording sheet to route RD6 or RD7. Plural switching claws G1 are supported on switching shaft 331, rotatably mounted on secondary fixing process device C. Plural switching claws G1 are aligned on switching shaft 331, across the recording sheet, in a direction perpendicular to the sheet conveying direction.

Switching shaft 331 is driven by a solenoid or the like, which is not illustrated. Said solenoid is controlled by a secondary fixing control section of secondary fixing process device C, whereby plural switching claws G1 can be switched to be in a secondary fix guiding condition, illustrated by solid lines, or to be in a bypass guiding condition, illustrated by dashed lines.

Figure 5:
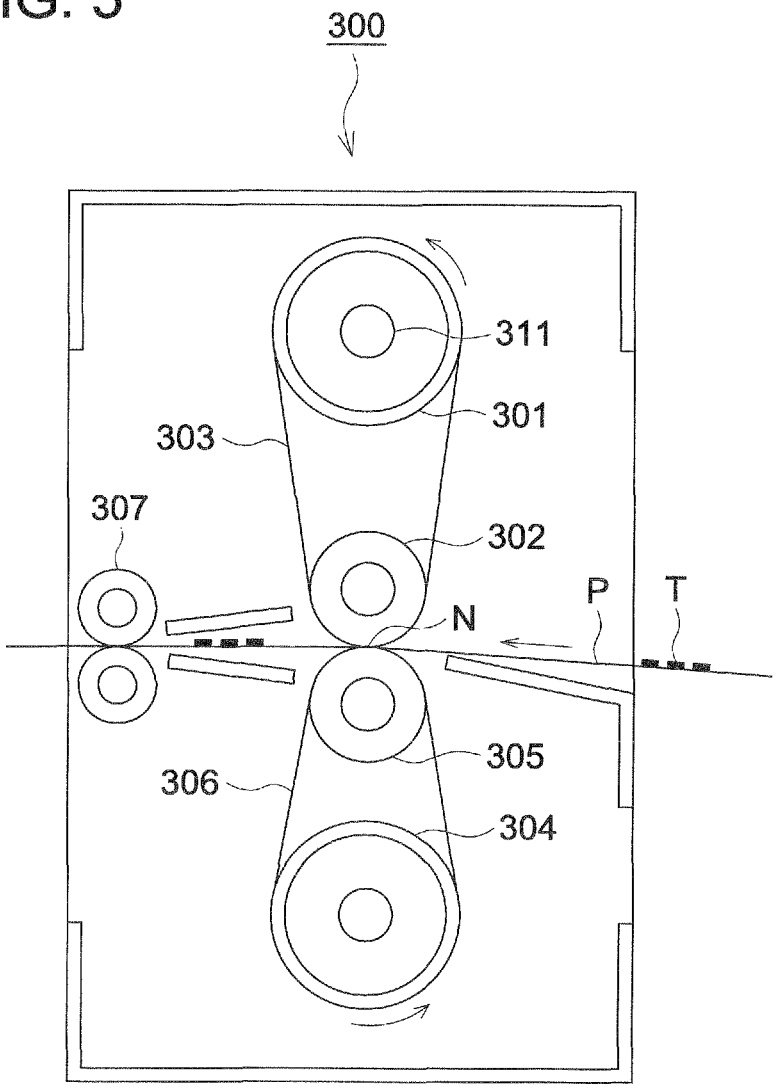
FIG. 5 is a cross-sectional view of secondary fixing device 300 relating to the present invention.

FIG. 5 is a cross-sectional view of secondary fixing device 300 relating to the present invention.

Secondary fixing device 300 has been offered to solve the problem that the fixing device mounted within the image forming apparatus cannot process a thick recording sheet carrying the high quality image exhibiting high brightness and high cleanness, and to solve the problem that the conventional art greatly reduces the processing speed to obtain a high quality image, so that the productivity of the apparatus is adversely reduced.

Secondary fixing device 300 has been formed to increase the smoothness (being the brightness) and the transparency of the toner images, formed on both surfaces of the recording sheet, having been fixed by the image forming apparatus. Accordingly, regarding the fixing process, various factors effecting the toner images are requested to be equal on both surfaces. That is, fixing members, which directly come into contact with the toner images on both surfaces, are preferably heated to the same temperature. In this embodiment, a belt fixing method is used, in which plural heated belts are configured to come into pressure contact with both surfaces of the recording sheet. In addition, a roller fixing method is also used, which is not limiting to the belt fixing method.

The fixing members of secondary fixing device 300 represent upper endless fixing belt 303, and lower endless fixing belt 306. Upper endless fixing belt 303 is entrained about upper heating roller 301 and upper fixing roller 302, while lower endless fixing belt 306 is entrained about lower heating roller 304 and lower fixing roller 305. Nipping section N, through which the recording sheet passes, is formed of upper fixing roller 302 and lower fixing roller 305, both being in pressure contact with each other.

Upper heating roller 301, formed of aluminum, with a diameter of 52 mm, and a thickness of 3 mm, includes upper heat source 311, in which is a halogen lamp. Upper heat source 311 is activated, based on a signal coming from a thermal sensor, not illustrated, arranged around upper heat roller 301, whereby upper heat roller 301 is controlled to a predetermined temperature.

Upper fixing belt 303 is formed of a polyimide resin base, having an outer circumference of 80 mm, with a thickness of 70 μm, a silicon rubber intermediate layer, with a thickness of 200 μm, formed on the polyimide resin base, and a polyphenylalkoxy resin surface, with a thickness of 30 μm, formed on the silicon rubber intermediate layer.

Upper fixing roller 302 has an outer diameter of 26 mm, wherein a silicon rubber layer, with a thickness of 2 mm, is formed on a cored stainless rod.

Lower heating roller 304 is formed to be equal to upper heating roller 301, while lower fixing belt 306 is formed to be equal to upper fixing belt 303. Lower fixing roller 305 is formed to be fundamentally similar to upper fixing roller 302. In this embodiment, in order to effectively separate the recording sheet from the belts, lower fixing belt 305 is formed to have a diameter of 24 mm, and its silicon rubber layer has a thickness of 1.5 mm.

[Recording Sheet Post-Finishing Device]

Figure 6:
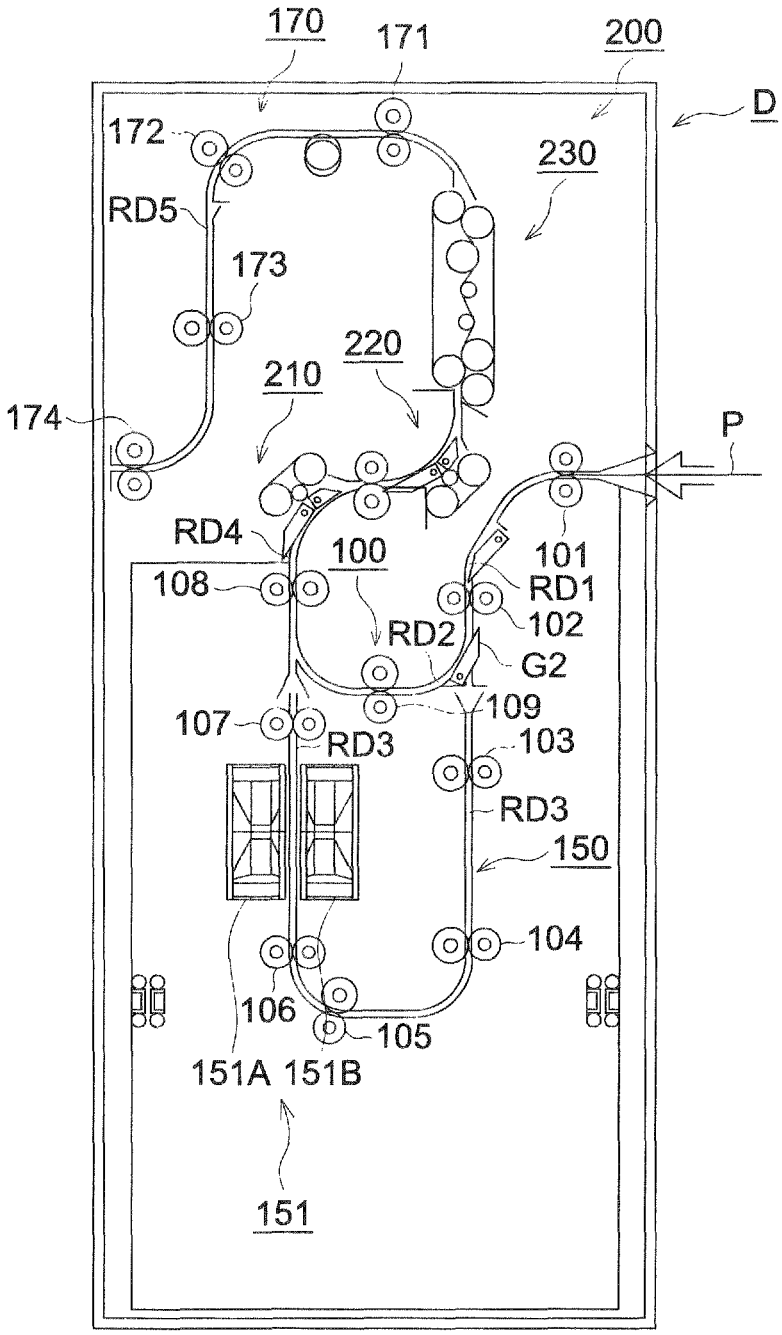
FIG. 6 shows a total structure of post-finishing device D relating to an embodiment of the present invention.

FIG. 6 shows the total structure of post-finishing device D relating to an embodiment of the present invention.

First conveying section 100 includes conveying route RD1, and conveying route RD2 which is mounted downstream of conveying route RD1. Second conveying section 150 includes conveying route RD1, and conveying route RD3, which is longer than and parallel to conveying route RD2. That is, conveying route RD1 is commonly used in both first conveying section 100 and second conveying section 150.

Recording sheet cooling section 151 is mounted on conveying route RD3, to actively cool both surfaces of recording sheet P being conveyed through conveying route RD3 of second conveying section 150.

Recording sheet cooling section 151 includes cooling fans 151A and 151B, to blow dried air onto both surfaces of recording sheet P. A post-finishing control section, which is not illustrated, switches cooling fans 151A and 151B to activate or not, when needed.

Curl flattening section 200, arranged downstream of both first conveying section 100 and second conveying section 150, is structured of first de-curler 210, second de-curler 220, and third de-curler 230, and includes conveying route RD4.

Recording sheet ejecting and conveying section 170, arranged downstream of curl flattening section 200, includes paired conveying rollers 171, 172, 173, and 174, and conveying route RD5 formed of plural guide members.

Conveying routes RD1, RD2, RD3, RD4, and RD5 are formed of plural guide members, as shown in FIG. 6.

Recording sheet P, having been conveyed to recording sheet post-finishing device D, is guided to first conveying section 100, or second conveying section 150, by a switching operation conducted by switching gate G2, being a switching section of the present invention. Subsequently, recording sheet P is conveyed through first conveying section 100, or second conveying section 150, to curl flattening section 200 and recording sheet ejecting and conveying section 170. After that recording sheet P is ejected from recording sheet post-finishing device D.

Figure 7:
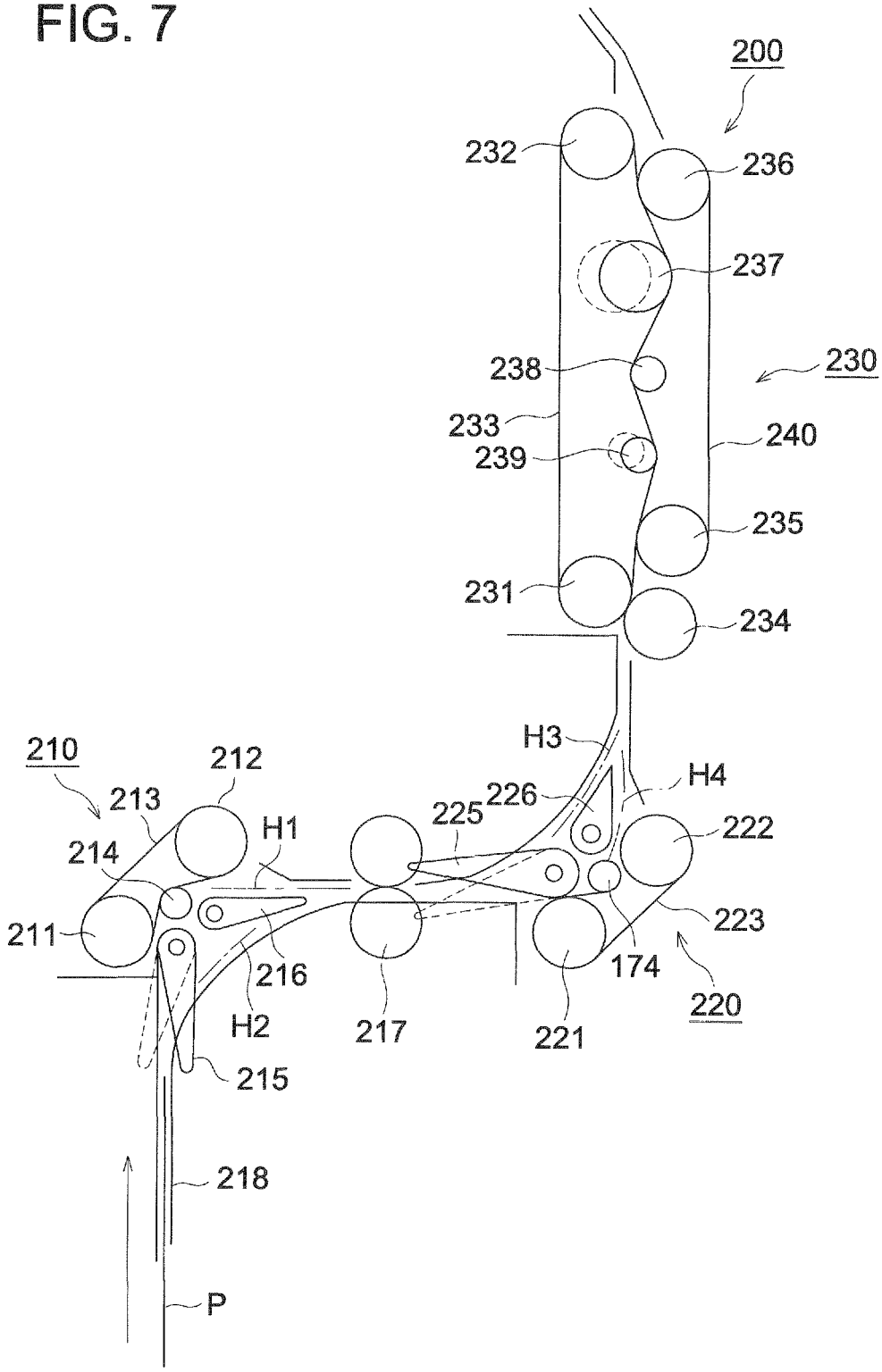
FIG. 7 is an enlarged drawing to show a structure of curl flattening section 200 relating to the present invention.

Each de-curler will now be detailed while referring to FIG. 7.

Curl flattening section 200 includes first de-curler 210, second de-curler 220, and third de-curler 230.

For first de-curler 210, belt 213 is entrained about rollers 211 and 212. Pressing roller 214 tightens belt 213.

Pressing roller 214 tightens belt 213 at an intermediate position between rollers 211 and 212, whereby a circular nip is formed on belt 213.

By the above structure, sheet conveying route H1 is formed to bend recording sheet P in the right direction, while using milers 211 and 212, belt 213, and pressing roller 214.

Switching claw 215 guides recording sheet P to conveying route H1 or H2, that is, switching claw 215 guides recording sheet P to conveying route H1 at a position illustrated by solid lines, and to conveying route H2 at a position illustrated by dashed lines.

Curled recording sheet P, having been guided to conveying route H1, is bent by rollers 211 and 212, belt 213, and pressing roller 214, so that curled recording sheet P is flattened.

Curled recording sheet P, having been guided to conveying route H2, passes through conveying route H2 having a gentle curve, so that said sheet P is not de-curled and conveyed to second de-curler 220.

Recording sheet P, coming from first de-curler 210, is conveyed to second de-curler 220 by paired conveying rollers 217.

On second de-curler 210, belt 223 is entrained about rollers 221 and 222. Pressing roller 224 tightens belt 221

Pressing roller 224 tightens belt 223 at an intermediate position between rollers 221 and 222, whereby a circular nip is formed on belt 223.

By the above structure, sheet conveying route H4 is formed to bend recording sheet P in the left direction, while using rollers 221 and 222, belt 223, and pressing roller 224.

Switching claw 225 guides recording sheet P to conveying route H3 or H4, that is, switching claw 225 guides recording sheet P to conveying route H4 at a position illustrated by solid lines, and to conveying route H3 at a position illustrated by dashed lines.

Curled recording sheet P, having been guided to conveying route H4, is bent by rollers 221 and 222, belt 223 and pressing roller 224, so that curled recording sheet P is flattened.

Curled recording sheet P, having been guided to conveying route H3, passes through conveying route H3 having a gentle curve, so that said sheet P is not de-curled and conveyed to third de-curler 230.

On third de-curler 230, belt 233 is entrained about rollers 231, 232, 237, and 239. Belt 240 is trained about rollers 235, 236, and 238.

Rollers 231, 232, 235-239 are arranged to make belts 233 and 244 move in a meandering motion.

Belt 233 and belt 240 are arranged to come into contact with each other, so that they sandwich recording sheet P and convey it.

Conveying roller 234 conveys recording sheet P to third de-curler 230.

Belt 233 is entrained about rollers 237 and 239. That is, rollers 237 and 239 are in contact with the inner periphery of belt 233, and press against the outer periphery of belt 240.

Belt 240 is entrained about roller 238 and the like. That is, roller 238 is in contact with the inner periphery of belt 240, and presses against the outer periphery of belt 233.

Rollers 237 and 239 can shift from the dashed line position to the solid line position.

Rollers 237 and 239 bend recording sheet P to the left to flatten recording sheet P at the solid line positions. Rollers 237 and 239 do not bend recording sheet P at the dashed line positions.

Roller 238 bends recording sheet P to the right to flatten recording sheet P, when rollers 237 and 239 are at the solid line positions.

Third de-curler 230 is configured to flatten recording sheet P, having a gentle curl. Accordingly, first de-curler 210 and seconded-curler 220 flatten recording sheet P, having a large curl, while third de-curler 230 flattens recording sheet P, having a remaining gentle curl.

Switching of claws 215 and 225, and changing the positions of rollers 237 and 239, in accordance with the type of recording sheet P, can make the curled recording sheet P to be a flattened sheet.

[Post-Finishing Control Section]

The structure of the post-finishing control section, serving as the control section of the present invention, and the uneven brightness preventing control to be conducted by the post-finishing control section will now be detailed below.

Figure 8:
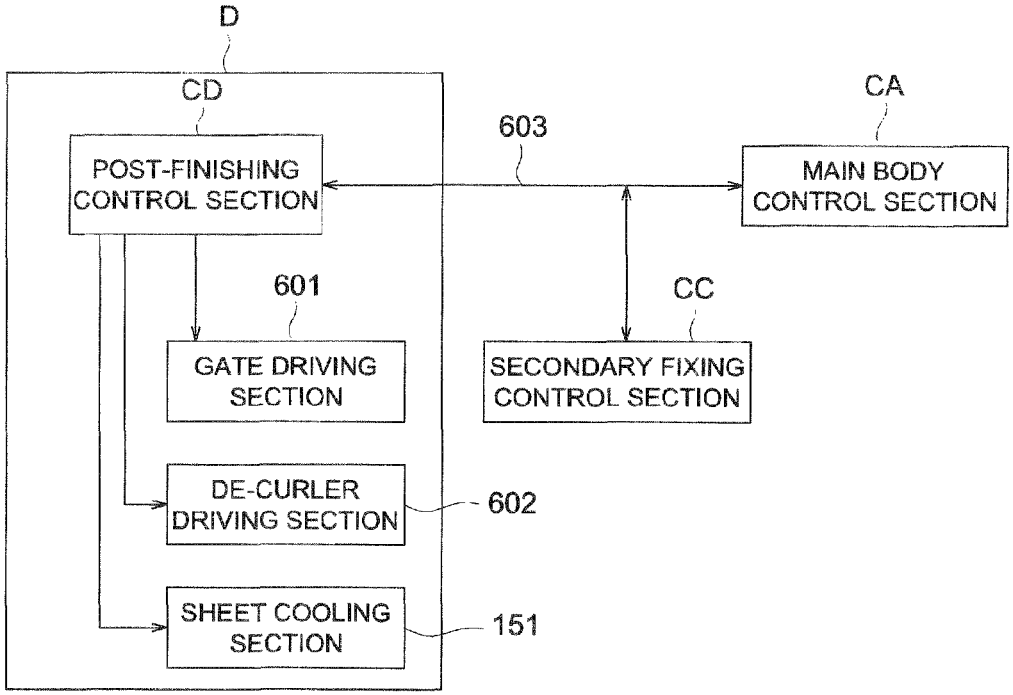
FIG. 8 is a block diagram to show a control operation of post-finishing control section CD which controls post-finishing device D.

FIG. 8 is a block diagram to show the control operation of post-finishing control section CD which controls post-finishing device D. As shown in FIG. 8, post-finishing control section CD communicates various control data (being jobs and status), through bus 603, with main body control section CA to control the image forming, apparatus, and with secondary fixing control section CC to control secondary fixing process device C.

Post-finishing control section CD controls gate driving section 601, to switch the position of switching gate G2, shown in FIG. 6, relating to the present invention.

Post-finishing control section further controls de-curler driving section 602, to switch the positions of switching claws 215 and 225, mounted on curl flattening section 200, and to switch the positions of rollers 237 and 239, shown in FIG. 7, relating to the present invention.

Post-finishing control section CD controls gate driving section 601, de-curler driving section 602, and recording sheet cooling section 151, based on control data, sent from main body control section CA.

Accordingly, the position of gate G2, shown in FIG. 6, the positions of switching claws 215 and 225, and the positions of rollers 237 and 239, shown in FIG. 7, or the operations of cooling fans 151A and 151B, shown in FIG. 6, can be appropriately switched over, based on the condition of recording sheet P which has been previously processed in the image forming apparatus and the secondary fixing process device, both arranged upstream of post-finishing device D.

In the above case, the control data include information of the recording sheet to be processed in the post-finishing device. Said information of the recording sheet includes information of the type of the recording sheet, and information of the fixing process, having been conducted in the image forming apparatus and the secondary fixing process device, both arranged upstream of post-finishing device D.

[Technology to Prevent Uneven Brightness]

The technology to prevent uneven brightness, effectively used in the image forming apparatus relating to the present invention, will be detailed below.

When the toner image, formed on a smooth sheet including a coated sheet, has been processed by the above described primary fixing device and secondary fixing device, an image can be obtained, which exhibits high brightness and cleanness of a wide color reproduction range. However, uneven brightness is adversely generated on contacting areas at which the toner image comes into contact with belts and rollers of curl flattening section 200, shown in FIG. 5. The uneven brightness is not generated on non-contacting areas at which the toner image does not come into contact with the belts and the rollers, so that the brightness on the non-contacting areas becomes greater than that of the contacting areas.

Said uneven brightness exhibits small differences of brightness, which is clearly visible to the unaided eye, so that said difference is visible to the unaided eye on the toner image which has been processed to high brightness (being smoothness). Accordingly, a recording sheet, other than a smooth sheet, is used, for example, a normal recording sheet having a rough surface is used, even if the toner image, carried on the normal recording sheet, is processed by both devices, including the fixing device of the image forming apparatus and the secondary fixing process device, a bright image, carrying the high brightness to generate the uneven brightness, cannot be obtained, so that no visible uneven brightness is generated.

Figure 9:
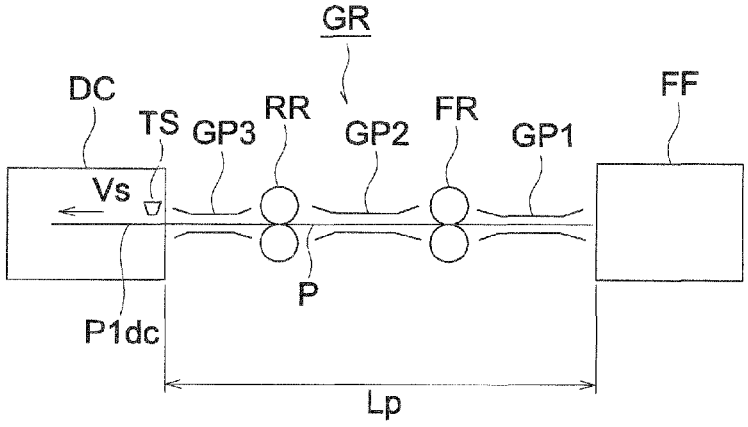
FIG. 9 is a drawing to show an experiment to obtain uneven brightness preventing conditions, concerning relationships between secondary fixing device 300 and curl flattening section 200.

FIG. 9 is a drawing to show an experiment, relating to the present invention, to obtain uneven brightness preventing conditions, concerning relationships between secondary fixing device 300 and curl flattening section 200.

Symbol FF represents a fixing device which finally conducts the fixing process onto recording sheet P being conveyed through the image forming system. That is, concerning image forming system T, shown in FIG. 1, if sheet P is conveyed through secondary fixing device 300, symbol FF represents secondary fixing device 300.

If sheet P is conveyed through conveying route RD7 shown in FIG. 4, and not through secondary fixing device 300, symbol FF represents the first fixing device mounted on image forming apparatus A.

In the present experiments, symbol FF represents secondary fixing device 300.

Symbol DC represents a de-curler mechanism, corresponding to curl flattening section 200 shown in FIG. 7. Symbol ride shows the arranged position of the first de-curler, mounted within de-curler mechanism DC, said arranged position is nearest the sheet entering side, and symbol TS represents a thermal sensor, mounted at position P1 dc to detect the temperature of recording sheet P. Symbol GR represents a conveying route, arranged between fixing device FF and de-curler mechanism DC, to guide recording sheet P. Conveying route GR is structured of paired guide plates GP1, GP2 and GP3, and paired conveying rollers RP and FR. Symbol Lp represents the length of conveying route GR. Symbol Vs represents the conveying velocity of recording sheet P.

When conveying velocity Vs and length Lp of conveying route GR are changed, temperature Ts of recording sheet P at position Pldc of the first de-curler has been detected, and the uneven brightness has been checked, which are shown in TABLE 1.

TABLE 1

| | Estimation of Uneven Brightness | |
|---|---|---|
| Temperature Ts of Sheet P | Ts < Twax | Ts ≥ Twax |
| Smooth Sheet | ○ | X |
| Normal Sheet | ○ | ○ |

Symbol "X" in TABLE 1 shows that the uneven brightness was visually observed, which were prints of the belt of the de-curler, whereby symbol X represents a bad range concerning the uneven brightness. Symbol "O" shows that no uneven brightness has been visually observed, whereby symbol X represents a good range concerning the uneven brightness.

TABLE 1 shows that:

(1) the uneven brightness, being the prints of the belts, is generated on the smooth sheet, on which the high brightness image is outputted by the fixing process, however, the uneven brightness is not generated on the normal sheet, and the prints of the belts are not visually observed; and (2) when the temperature of the smooth sheet, to be conveyed to the de-curling device, is high than crystallization temperature Twax of the offset preventing agents (hereinafter referred to as "wax" included in the toner particles, the uneven brightness, being the prints of the belt, is generated. When the temperature of the smooth sheet is not higher than crystallization temperature Twax of the wax, uneven brightness, being the prints of the belt, is not generated.

Based on the above results, if the smooth recording sheet has been fixed, and cooled to be less than crystallization temperature Twax of the wax, and is conveyed to the de-curling device, the uneven brightness, being the prints of the belt, can be prevented from occurring. That is, if length Lp of conveying route GR is lengthened, so that temperature Ts of the recording sheet is decreased to be less than crystallization temperature Twax of the wax, the uneven brightness can be prevented, while the production ability is not reduced.

In this case, crystallization temperature Twax of the wax represents the temperature of coagulation point of the wax. That is, the wax, included in the toner, is measured by the differential scanning calorimeter method (being DSC). In the present experiments, the wax, included in the toner, shows 55-59° C. as crystallization temperature Twax.

Crystallization temperature Twax of the wax, which will be detailed later, is measured by differential scanning calorimeter DSC-7, (Perkin-Elmer Co.), and thermal analysis instrument controller TAC 7/DX (Perkin-Elmer Co.).

Measuring procedure: Toner particles, 4.5-5.0 mg, precisely calculated to two decimal places, are encapsulated into an aluminum pan (Kit No. 0129-0041), and said pan is set on a sample holder of differential scanning calorimeter DSC-7. An empty aluminum pan is used as a reference.

Measuring Condition: Temperature control, including "heating-cooling-heating procedures", is conducted with the measuring temperature 0-100° C., the rate of temperature increase is 10° C./minute, and the rate of temperature decrease is 10° C./minute.

Analysis and Determination of Coagulation Point: Based on the outputted data of differential scanning calorimeter DSC-7 during the cooling procedure, the heat generation distribution of the wax is analyzed, whereby a temperature showing a peak top of the heat generation is determined as the coagulation temperature, that is, the crystallization temperature.

The relationships, between the figures of paired conveying rollers FR and RR, and the uneven brightness (being the prints of rollers) are studied, as the next procedure.

Figure 10:
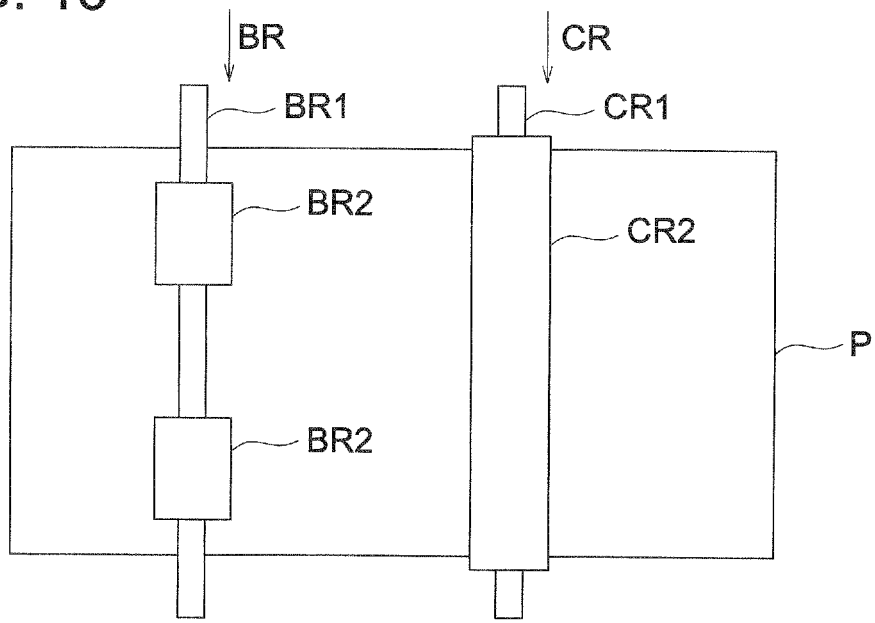
FIG. 10 shows narrow roller assembly BR and broad roller assembly CR as an example of paired conveying rollers.

FIG. 10 shows narrow roller assembly BR and broad roller assembly CR as the paired conveying rollers.

Narrow roller assembly BR is structured of shaft BR1 and elastic narrow rollers BR2, such as rubber rollers, mounted on shaft BR1, while broad roller assembly CR is structured of shaft CR1 and elastic broad roller CR2, such as a rubber roller, mounted on shaft CR1. Broad roller CR2 is a straight roller, having the same diameter across the total width of recording sheet P, perpendicular to the conveying direction of recording sheet P. That is, broad roller CR2 has the same diameter in its axial direction, and is longer than the width of recording sheet P, so that broad roller CR2 can continuously cover the total width of recording sheet P.

The relationships, between the figures of paired conveying rollers FR and RR, and the uneven brightness, are studied and which are shown in TABLE 2.

TABLE 2

| | Estimation of Uneven Brightness | |
|---|---|---|
| Figure of Conveying Roller | Broad Roller | Narrow Roller |
| Smooth Sheet | ○ | X |
| Normal Sheet | ○ | ○ |

Symbol "X" in TABLE 2 shows that the uneven brightness was visually observed, whereby symbol X represents a bad range concerning the uneven brightness. Symbol "O" shows that no uneven brightness has been visually observed, whereby symbol X represents a good range concerning the uneven brightness.

By narrow rollers BR2 in FIG. 10, recording sheet P has contacted areas to be contacted with narrow rollers BR2, and a non-contacted area not to be contacted with narrow rollers BR2. High brightness portions are generated on the contacted areas, and streaking uneven brightness portions are generated on the toner images on the contacted areas of recording sheet P.

In case of broad roller assembly CR, broad roller CR2 in FIG. 10 contacts the total area across the width of recording sheet P, so that no uneven brightness is generated on the contacted area. However, if broad roller CR2 is formed of metal to be a rigid roller, from the microscopic points of view, a condition exists on recording sheet P, including areas to be strongly contacted with broad roller CR2, an area not to be contacted with broad roller CR2, or areas to be softly contacted with broad roller CR2. Due to this condition, uneven brightness, which differs from that formed by narrow rollers BR2, may exist on the toner images on the smooth recording sheet, highly smoothed by the fixing process. Accordingly, materials to be used for the surface of broad roller CR2 should be elastic, such as a rubber.

The relationships, between the effect of the de-curling operation conducted by curl flattening section 200 shown in FIG. 7, and route length Lp of route length GR, will be detailed below. After the fixing process has been conducted on recording sheet. P by the primary fixing device and the secondary fixing device, various distortions are generated on the recording sheet, by the figures of the toner images formed on both surfaces of the recording sheet, and by the characteristics of the recording sheet.

The closer curl flattening section 200 is mounted to the fixing device, the more the effect of the de-curling operation is increased. That is to say, if curl flattening section 200 is mounted at a position where the temperature of the fixed recording sheet is high, the effect of the de-curling operation can be increased. In the present experiments, when the fixed recording sheet has arrived at de-curler mechanism DC (being curl flattening section 200), if temperature Ts of the fixed recording sheet is approximately higher than 60° C., curl flattening section 200 can effectively flatten the fixed recording sheet. Said temperature "60° C." is nearly equal to crystallization temperature Twax or higher.

In case of a smooth recording sheet, such as a coated sheet, the distortion (such as curling of the sheet) is generated to be less, after the recording sheet has been fixed. Therefore, when temperature Ts of the smooth recording sheet is excessively less than crystallization temperature Twax, curl flattening section 200 can flatten the smooth recording sheet.

As stated above, in case of a recording sheet, such as a normal sheet, on which no uneven brightness has been generated, the fixed recording sheet should be conveyed to curl flattening section 200, while temperature Ts of said fixed recording sheet is kept as high as possible, that is, route length Lp of conveying route GR should be determined to be as short as possible. Specifically, when the recording sheet has arrived at curl flattening section 200, temperature Ts of the recording sheet should be greater than 60° C., that is, route length Lp, by which temperature Ts can be kept to be higher than crystallization temperature Twax, can conduct the effective de-curling operation.

Figure 11:
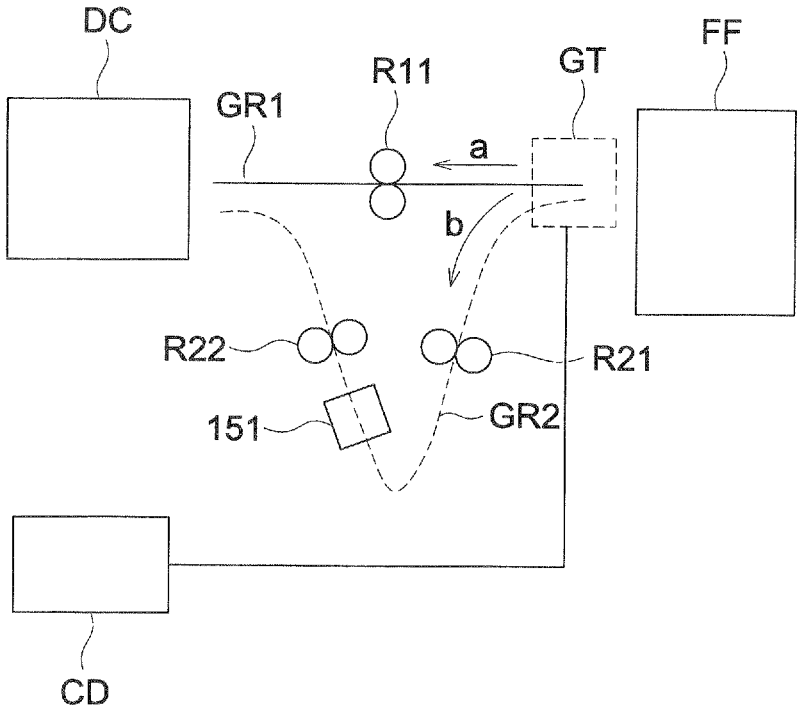
FIG. 11 is a schematic drawing to show a principle of uneven brightness preventing technology relating to the present invention.

FIG. 11 is a schematic drawing to show a principle of the uneven brightness preventing technology, relating to the present invention.

The present technology, relating to the sheet post-finishing operation after the fixing operation, is able to output an image, exhibiting high image quality, carrying no uneven brightness, and no curling on the various type of recording sheets, without reducing productivity (which represents the number of recording sheets to be processed in a unit time).

Symbol FF in FIG. 11 represents a fixing device by which a final fixing process is conducted on recording sheet P, being conveyed through the image forming system. Symbol DC is the de-curler mechanism which corresponds to curl flattening section 200 shown in FIG. 7. Symbol CD represents a post-finishing control section, serving as the control section of the present invention, shown in FIG. 8.

First conveying route GR1, which is arranged between fixing device FF and de-curler mechanism DC, guides recording sheet P to de-curler mechanism DC. Second conveying route GR2, which is longer than first conveying route GR1, guides recording sheet P to de-curler mechanism DC. Second conveying route GR2 exhibits a specific length, through which temperature Ts of recording sheet P, having been fixed by fixing device FF, is reduced to not less than wax crystallization temperature Twax. Further, second conveying route GR2 includes sheet cooling device 151, shown in FIG. 6, to actively cool recording sheet P.

Switching gate GT guides recording sheet P to either first conveying route GR1 or second conveying route GR2.

Post-finishing control section CD is configured to determine the type of recording sheet P, conveyed from fixing device FF.

If post-finishing control section CD determines that recording sheet P is a specific sheet (for example, a smooth sheet being a coated sheet), on which a high brightness process has been conducted by the fixing device, mounted at the more upstream side, post-finishing control section CD controls switching gate CT to guide recording sheet P to second conveying route GR2, as shown by symbol "b" in FIG. 11.

Further, if post-finishing control section CD determines that recording sheet P, conveyed from fixing device FF, is a sheet, other than a specific sheet, (that is, recording sheet P has been determined as a normal sheet), post-finishing control section CD controls switching gate GT to guide recording sheet P to first conveying route GR1, as shown by symbol "a" in FIG. 11.

Still further, if post-finishing control section CD determines that on recording sheet P, conveyed from fixing device FF, the high brightness process has not been conducted by the fixing device, which is mounted more upstream, post-finishing control section CD controls switching gate GT to guide recording sheet P to first conveying route GR1, as shown by symbol "a" in FIG. 11.

In case that sheet cooling section 151 is activated, post-finishing control section CD determines that recording sheet P is a second specific sheet (for example, a sheet thicker than the specific sheet), on which the high brightness process has been conducted by the fixing device, mounted at the more upstream side, post-finishing control section CD controls switching gate GT to guide recording sheet P to second conveying route GR2, as shown by symbol "b" in FIG. 11, and post-finishing control section CD controls sheet cooling section 151, mounted on second conveying route GR2, to actively cool recording sheet P.

In addition, if post-finishing control section CD determines that recording sheet P is a specific sheet, including a second specific sheet, post-finishing control section CD may activate sheet cooling section 151.

Paired conveying rollers R21 and R22, mounted on second conveying route GR2, are broad roller assembly CR shown in FIG. 10. On the other hand, paired conveying rollers R11, mounted on first conveying route GR1, are not necessary to be paired rollers R11, but to be narrow roller assembly BR, shown in FIG. 10.

The structure of the uneven brightness preventing technology will now be detailed, while referring to FIG. 6. First conveying route GR1, shown in FIG. 11, relating to the present invention, is a route which is formed from an upstream portion of paired conveying rollers 101 to a downstream portion of paired conveying rollers 108, that is, first conveying route GR1 includes conveying route RD1 and conveying route RD2.

Second conveying route GR2, shown in FIG. 11, relating to the present invention, is a route which is formed from an upstream portion of paired conveying rollers 101 to a downstream portion of paired conveying rollers 108, that is, second conveying route GR2 includes conveying route RD1 and conveying route RD3.

Paired conveying rollers 101-108 are broad roller assemblies CR shown in FIG. 10. However, paired conveying rollers 109, which are mounted on conveying route RD2, are not limited to broad roller assemblies CR, but are narrow roller assemblies BR shown in FIG. 10. Paired conveying rollers 101-108 have diameters of 22 mm, and their surfaces are covered with the rubber.

Switching gate G2, shown in FIG. 6, is driven by gate driving section 601.

Post-finishing control section CD, shown in FIGS. 8 and 11, is a control section of the present invention, to conduct the total control of sheet post-finishing device D. Post-finishing control section CD checks the type of recording sheet P which is conveyed from secondary fixing process device C. If post-finishing control section CD determines that the type of recording sheet P is a specific sheet (for example, a smooth sheet), post-finishing control section CD sends a signal to gate driving section 601, shown in FIG. 8, whereby recording sheet P is conveyed to conveying route RD3. Based on the signal, sent Thom post-finishing control section CD, gate driving section 601 switches switching gate G2 to a position by which recording sheet P is conveyed to conveying route RD3.

In the present experiments, if conveying speed Vs of recording sheet P was set to be 400 mm/s, and the length of conveying route RD3 was 950 mm, when recording sheet P entered sheet post-finishing device D, the temperature of recording sheet P was approximately 85° C., however, when recording sheet P arrived at curl flattening section 200, the temperature of recording sheet P could be reduced to be lower than 85° C.

The temperature of recording sheet P, entering sheet post-finishing device D, depends upon the fixing temperature of secondary fixing device 300, the type of the recording sheet (such as a normal sheet, and a coated sheet), and the basis weight of the recording sheet. Further, it depends upon the amount of toner on the image. If the basis weight becomes great, or the amount of toner becomes great, the temperature of recording sheet P, entering sheet post-finishing device D, becomes high. Further, even if the basis weight of the coated sheet is equal to that of a normal sheet, the temperature of the coated sheet is higher than that of a normal sheet entering sheet post-finishing device D.

Under a condition that the fixing temperature of secondary fixing device 300 is 160° C., the conveying speed of recording sheet P is 400 mm/s, and a solid blue image, carrying the toners of approximately 8 g/m$^2$ (the blue image is formed of cyan and magenta layers as the solid image) is formed on recording sheet P, the temperature of recording sheet P, entering sheet post-finishing device D, was approximately 85° C., for the coated sheet of basis weight of 128 g/m$^2$, and was approximately 75° C., for a normal sheet of basis weight of 80 g/m$^2$.

In case that sheet cooling device 151 is activated, even if the conveying route is set to be less than 950 mm, temperature Ts of recording sheet P, arriving at curl flattening section 200, can be reduced to less than 55° C. For example, in FIG. 6, three cooling fans 151A and three cooling fans 151B, each being a size of 60 mm×60 mm, were arranged to blow air at a right angle onto both surfaces of recording sheet P. Though a route length of 500 mm was used with sheet cooling device 151, the temperature of recording sheet P could be reduced to be equal to the case of a route length of 950 mm, without using sheet cooling device 151.

If post-finishing control section CD determines that the type of recording sheet P is a sheet other than a specific sheet (for example, a normal sheet), post-finishing control section CD sends a signal to gate driving section 601, shown in FIG. 8, whereby recording sheet P is conveyed to first conveying route GR1. Based on the signal, sent from post-finishing control section CD, gate driving section 601 switches switching gate G2 to a position by which recording sheet P is conveyed to first conveying route GR1.

If first conveying route GR1 is formed to have the length through which while recording sheet P is conveyed from fixing device FF to de-curler mechanism DC, temperature Ts of recording sheet P is kept approximately to be more than 60° C., that is, if the length of first conveying route GR1 is possible to keep the temperature of recording sheet P at more than crystallization temperature Twax, de-curler mechanism DC can exhibit the excellent sheet flattening operations.

The present experiments were conducted under the conditions that the length of first conveying route GR1 was 460 mm, the fixing temperature of secondary fixing device 300 was 160° C., the conveying speed of recording sheet P is 400 mm/s, and the solid blue image is formed on recording sheet P. Under the above conditions, when recording sheet P has entered sheet post-finishing device D, temperature Ts of recording sheet P was approximately 75° C., and when recording sheet P arrived at curl flattening section 200, temperature Ts of recording sheet P was kept to be more than 60° C.

As detailed above, the image forming system is able to output an image, exhibiting high image quality, carrying no uneven brightness, and no curling on the various types of recording sheets, without reducing the productivity (which represents the number of recording sheets to be processed in a unit time).

The image forming system described above includes image forming apparatus A, secondary fixing process device C, and sheet post-finishing device D, however, the present invention is not limited to these, that is, sheet post-finishing device D can be mounted downstream of image forming apparatus A. Further, an image forming apparatus, having therein a fixing device and a curl flattening section, both relating to the present invention, is also included in the present invention.

In addition, recording sheet cooling section 151 of sheet post-finishing device D, which was described above, may be arranged at downstream of a moisturizing section, described in Unexamined Japanese Patent Application 2007-286151, as an integral structure. Accordingly, said recording sheet cooling section 151 can be formed of plural air blow fans which are configured to blow air against both surfaces of recording sheet P, and to evaporate extra water from recording sheet P, just after the humidification step, whereby conveying route forming members, such as conveying rollers, are prevented from receiving water on their surfaces.

Concerning the effect of the present invention, the present invention makes it possible to offer an image forming apparatus which rapidly forms high quality images, exhibiting no uneven brightness, regardless of the type of recording sheet, and to offer an image forming system which includes the same type of image forming apparatus. Because the first conveying route, and the second conveying route, being longer than the first conveying route, are provided between the fixing device and the curl flattening section. The control section controls the switching section to convey the specific recording sheet through the second conveying route, to convey a recording sheet, other than a specific recording sheet, through the first conveying route.

What is claimed is:

1. An image forming system comprising:

a fixing device which applies heat and pressure onto a toner image formed on a recording sheet to fix the toner image on the recording sheet;

a curl flattening section for flattening a curl formed on the recording sheet, and conveying the recording sheet in a downstream direction of the fixing device with respect to a sheet conveying direction;

a first conveying route for conveying the recording sheet having been processed by the fixing device to the curl flattening section;

a second conveying route, which is longer than the first conveying route, for conveying the recording sheet having been processed by the fixing device to the curl flattening section;

a switching section for switching the conveying route of the recording sheet, having been processed by the fixing device, to guide the recording sheet to one of the first conveying route and the second conveying route;

a determining section for determining a type of the recording sheet which has been processed by the fixing device and which is to be conveyed to the curl flattening section; and a control section for controlling the switching section to guide the recording sheet, having been processed by the fixing device, to one of the first conveying route and the second conveying route, based on the type of the recording sheet determined by the determining section.

2. The image forming system of claim 1, wherein when the type of the recording sheet is determined to be a specific recording sheet, the control section controls the switching section to guide the recording sheet to the second conveying route, and when the type of the recording sheet is determined to be other than the specific recording sheet, the control section controls the switching section to guide the recording sheet to the first conveying route.

3. The image forming system of claim 1, wherein the second conveying route has a route length such that while the recording sheet is conveyed along the second conveying route from the fixing device to the curl flattening section, a temperature of the recording sheet is lowered to be lower than a crystallization temperature of a wax included in a toner of the toner image.

4. The image forming system of claim 1, wherein the first conveying route has a route length such that while the recording sheet is conveyed along the first conveying route from the fixing device to the curl flattening section, a temperature of the recording sheet is kept to be not lower than a crystallization temperature of a wax included in a toner of the toner image.

5. The image forming system of claim 1, wherein a sheet cooling section to cool the recording sheet is provided along the second conveying route.

6. The image forming system of claim 1, wherein the fixing device comprises:

a first fixing device for fixing the toner image on the recording sheet, which has not yet been fixed; and a second fixing device, mounted downstream of the first fixing device with respect to the sheet conveying direction, for again fixing the toner image having been fixed by the first fixing device.

7. The image forming system of claim 6, further comprising an image forming apparatus, a second fixing process device, and a sheet post-finishing device, wherein:

the image forming apparatus includes the first fixing device;

the second fixing process device is connected to the image forming apparatus and includes the second fixing device; and the sheet post-finishing device is connected to the second fixing process device and includes the first conveying route, the second conveying route, the curl flattening section, and the control section.

8. The image forming system of claim 1, wherein a plurality of the curl flattening sections are provided.

9. The image forming system of claim 8, wherein the curl flattening sections are provided at both sides of a sheet conveying route to sandwich the sheet conveying route.

10. A sheet post-finishing device to finish a recording sheet carrying a toner image having been fixed by heat and pressure, the post-finishing device comprising:

a curl flattening section for flattening a curl formed on the recording sheet carrying a fixed toner image, and for conveying the recording sheet carrying the fixed toner image in a sheet conveying direction;

a first conveying route for conveying the recording sheet carrying the fixed toner image to the curl flattening section;

a second conveying route, which is longer than the first conveying route, for conveying the recording sheet carrying the fixed toner image to the curl flattening section;

a switching section for switching a conveying route of the recording sheet carrying the fixed toner image, to guide the recording sheet to the first conveying route or the second conveying route;

a determining section for determining a type of the recording sheet carrying the fixed toner image which is to be conveyed to the curl flattening section; and a control section for controlling the switching section to guide the recording sheet carrying the fixed image to one of the first conveying route and the second conveying route, based on the type of the recording sheet carrying the fixed toner image determined by the determining section.

11. The post-finishing device of claim 10, wherein when the type of the recording sheet is determined to be a specific recording sheet, the control section controls the switching section to guide the recording sheet to the second conveying route, and when the type of the recording sheet is determined to be other than the specific recording sheet, the control section controls the switching section to guide the recording sheet to the first conveying route.

12. The post-finishing device of claim 10, wherein the second conveying route has a route length such that while the recording sheet carrying the fixed toner image is conveyed along the second conveying route to the curl flattening section, a temperature of the recording sheet is lowered to be lower than a crystallization temperature of a wax included in a toner of the toner image.

13. The post-finishing device of claim 10, wherein the first conveying route has a route length such that while the recording sheet carrying the fixed toner image is conveyed along the first conveying route to the curl flattening section, a temperature of the recording sheet is kept to be not lower than a crystallization temperature of a wax included in a toner of the toner image.

14. The post-finishing device of claim 10, wherein a sheet cooling section is provided along the second conveying route.

15. An image forming system comprising:

a fixing device which fixes a toner image on a recording sheet by applying heat and pressure onto the toner image formed on the recording sheet; and a sheet post-finishing device to finish the recording sheet; wherein the post-finishing device includes:

a curl flattening section for flattening a curl formed on the recording sheet, and conveying the recording sheet in a sheet conveying direction;

a first conveying route for conveying the recording sheet carrying a toner image having been fixed by the fixing device, to the curl flattening section;

a second conveying route, which is longer than the first conveying route, for conveying the recording sheet carrying the toner image having been fixed by the fixing device, to the curl flattening section;

a switching section for switching a conveying route of the recording sheet, having been fixed by the fixing device, to guide the recording sheet to one of the first conveying route and the second conveying route;

a determining section for determining a type of the recording sheet which has been fixed by the fixing device and which is to be conveyed to the curl flattening section; and a control section for controlling the switching section to guide the recording sheet, having been fixed by the fixing device, to one of the first conveying route and the second conveying route, based on the type of the recording sheet determined by the determining section.

16. The image forming system of claim 15, wherein the fixing device comprises:

a first fixing device for fixing the toner image on the recording sheet, which has not yet been fixed, and a second fixing device, mounted at a downstream side of the first fixing device with respect to the sheet conveying direction, for again fixing the toner image having been fixed by the first fixing device.

17. The image forming system of claim 16, further comprising an image forming apparatus and a second fixing process device, wherein:

the image forming apparatus includes the first fixing device;

the second fixing process device is connected to the image forming apparatus and includes the second fixing device; and the post-finishing device is connected to a downstream side of the second fixing process device.

* * * * *